US005967879A

United States Patent [19]

Gottschald

[11] Patent Number: 5,967,879

[45] **Date of Patent: *Oct. 19, 1999**

[54] PROCESS AND SYSTEM TO MACHINE AND IN PARTICULAR TO GRIND THE OPTICAL SURFACES AND/OR CIRCUMFERENTIAL EDGE OF EYEGLASS LENSES

[76] Inventor: Lutz Gottschald, Am Meerbusch 5, D-40670 Meerbusch, Germany

[ * ] Notice: This patent is subject to a terminal disclaimer.

[21] Appl. No.: 08/999,566

[22] Filed: Dec. 15, 1997

Related U.S. Application Data

[62] Division of application No. 08/233,813, Apr. 26, 1994, abandoned.

[51] Int. Cl.[6] ..... B24B 49/00

[52] U.S. Cl. ..... 451/5; 451/10; 451/11; 451/256

[58] Field of Search ..... 451/5, 42, 255, 451/256, 277, 390, 11, 10

[56] References Cited

U.S. PATENT DOCUMENTS

| | | | |
|---|---|---|---|
| 5,148,637 | 9/1992 | Byron | 451/5 |
| 5,231,587 | 7/1993 | Frost | 451/5 |
| 5,257,198 | 10/1993 | Van Schoyck | 451/5 |
| 5,333,412 | 8/1994 | Matsuyama | 451/5 |
| 5,341,604 | 8/1994 | Wood | 451/5 |
| 5,454,194 | 10/1995 | Gottschald | 451/5 |

*Primary Examiner*—Robert A. Rose
*Assistant Examiner*—George Nguyen
*Attorney, Agent, or Firm*—M. G. Marinangeli; Klein & Vibber Esqs

[57] ABSTRACT

A process and system to machine and in particular to grind eyeglass lenses, with at least one machining tool, a grinding disk, a rotatable holder for an eyeglass lens blank, a unit to control machining in accordance with predetermined optical values and/or a predetermined circumferential contour of the eyeglass lens, a CNC-controlled handling unit for exactly positioned insertion of an eyeglass lens blank in the holder, a control unit for the handling unit, and an input device for the decentration values for the predetermined circumferential contour in reference to the optical axis of the eyeglass lens. The utilization of the handling unit eliminates the difficult and time-consuming manual centering of the eyeglass lens blank. Multiple eyeglass lens grinding machines can be loaded by the handling unit.

13 Claims, 5 Drawing Sheets

PROCESS AND SYSTEM TO MACHINE AND IN PARTICULAR TO GRIND THE OPTICAL SURFACES AND/OR CIRCUMFERENTIAL EDGE OF EYEGLASS LENSES

CROSS-REFERENCE TO RELATED PATENT APPLICATION

This application is a divisional application of the copending application Ser. No. 08/233,813, filed on Apr. 26, 1994, abandoned and entitled ARRANGEMENT FOR FINISHING THE OPTICAL SURFACES AND/OR EDGES OF CORRECTIVE LENSES

BACKGROUND OF THE INVENTION

The invention relates to a process and a system for machining and in particular for grinding the circumferential edge of eyeglass lenses with a machining tool, and in particular a grinding disk, a rotatable holder for an eyeglass lens blank and a device to control machining in accordance with a predetermined circumferential contour for the eyeglass lens.

Eyeglass edging machines are known in the art and in their simplest form may include a device to control grinding in accordance with a predetermined circumferential contour for the eyeglass lens represented by the shape of a template mounted on the rotatable holder and corresponding to the shape of the eyeglass frame opening into which the shaped eyeglass lens is to be inserted. If eyeglass lenses made of silicate glass are machined, diamond-coated grinding disks are used as a rule, while milling tools are often used to machine plastic lenses.

CNC-controlled eyeglass edging machines are also already known and are described, for example, in U.S. Pat. No. 4,945,684 or in European published unexamined patent specification 0 363 281. CNC-controlled eyeglass lens grinding machines, which grind the optical surfaces in addition, are described in European Patent Specification 0 061 918 and in U.S. Pat. No. 5,210,695 (published after the priority filing date of the present application).

In the CNC-controlled eyeglass lens edging machines, the circumferential contour of the eyeglass lens is available in the form of a data set which is used to control the grinding procedure in such a way that the predetermined circumferential contour of the eyeglass lens will be created.

Common to the purely mechanical and the CNC-controlled eyeglass lens grinding machines is the requirement that the insertion of the eyeglass lens blank in the holder is effected manually, which is time-consuming and which requires a certain degree of skill.

Before the eyeglass lens blank can be mounted in the rotatable holder of a conventional eyeglass lens grinding machine, the eyeglass lens blank must be fitted with a sucker or holder block, which must be positioned in accordance with the decentration values determined by the optician for the predetermined circumferential contour with reference to the optical axis of the eyeglass lens and which serves to exactly position the eyeglass lens blank in the rotatable holder and to make a connection with the rotatable holder resistant to relative rotation.

If the eyeglass lens exhibits a cylindrical or prismatic grind, then the axial orientation is also to be taken into consideration when applying the sucker or holder block and when inserting the lens blank in the rotatable holder of the eyeglass lens edging machine.

A further difficulty arises when eyeglass lenses are in the form of multi-focal lenses, since in this case the location of the close vision section with reference to the optical axis of the distant vision section must be taken into consideration.

To apply a sucker or holder block a device is used with which the eyeglass lens blank is initially oriented in accordance with the optical values, the decentration values and/or the axial orientation; then the sucker or holder block is attached to the pre-positioned eyeglass lens blank. A device of this type is described in U.S. Pat. No. 3,586,448.

It is quite apparent that this procedure is time-consuming and requires great professional skill, so that these activities can be carried out only by trained opticians. Due to the time-consuming positioning and blocking of each eyeglass lens blank, however, the output of the conventional eyeglass lens grinding machine, particularly if it is a CNC-controlled type, is low.

A loading unit at a CNC-controlled eyeglass lens edging machine known from U.S. Pat. No. 5,148,637 (published after the priority filing date of the present application) is suited only for loading exactly along the optical axis, so that the decentration values must be taken into account in the processing control program, whereby the calculation work is increased quite considerably and a very high-performance computer is required. The axial orientation where a cylindrical grind or prismatic grind is present and the location of a close vision section cannot be taken into consideration at all when using such a loading unit.

SUMMARY OF THE INVENTION

It is a general object of the invention to provide a simplification and acceleration of the manufacturing process of an eyeglass lens in accordance with a predetermined circumferential contour taking the optical data into account, i.e. refraction, axial orientation of a cylindrical or prismatic grind and/or location of the close-vision section of the eyeglass lens and the decentration values for the eyeglass lens in the selected eyeglass frame and to improve the accuracy during manufacturing.

Based on this objective, proposed by way of invention are a process and a system to grind the circumferential edge of eyeglass lenses in which, by way of invention, a CNC-controlled handling device is used for exactly positioned insertion of an eyeglass lens blank in the holder of an eyeglass lens manufacturing machine and a control unit with an input device for the decentration values for the predetermined circumferential contour with reference to the optical axis of the eyeglass lens is used to control the handling device. The handling device then grasps an eyeglass lens blank at the edge and inserts it in the opened holder at the eyeglass lens grinding machine. Here the handling device is controlled so that the eyeglass lens blank is positioned in reference to the rotation axis of the holder to correspond to the decentration values which had been entered. When the holder thereafter clamps the eyeglass lens blank and the handling device releases the eyeglass lens blank, the machining process in accordance with predetermined optical values and/or in accordance with a predetermined circumferential contour of the eyeglass lens can be effected taking the decentration values into account.

If the optical surfaces of the eyeglass lens have already been ground, the eyeglass lens blank, for which only the circumferential contour must be ground to match the shape of the eyeglass lens opening in the selected eyeglass frame, will be inserted in an eyeglass lens edging machine. The handling device carries out this insertion for exactly positioning under CNC-control, taking into account the decentration values, the axial orientation of a cylindrical or prismatic grind, if present, and the location of a close vision section, if present.

If the optical surface of the eyeglass lens blank is also to be ground in accordance with the optical data, then the handling device will first position the eyeglass lens blank, exactly positioned, in a machine to grind the optical surface, removing it after conclusion of the grinding of the optical surfaces and then placing it exactly positioned in an eyeglass lens edging machine, wherein the decentration values, the axis orientation of a cylindrical or prismatic grind, if present, and the location of a close vision section, if present, are taken into consideration in the fashion previously described.

The controls for the handling device can also be used to control the grinding process for the optical surface and/or the peripheral edge, particularly where the rotatable holder for an eyeglass lens blank is located at the handling device. In this case the machines used to grind the optical surfaces and the circumferential edge can be of very simple design, since they need be equipped only with a rotating tool to grind the optical surfaces and/or the circumferential edge. The movements of the eyeglass lens, needed to grind the optical surface and the circumferential edge, comprising translatory and/or rotary motions, are executed in this case by the handling device, which for this purpose may exhibit a rotatable holder to process the circumferential edge of eyeglass lenses and a further rotatable holder for grinding the optical surfaces and executes under CNC control the required movements referenced to the rotating grinding tools.

The handling device used to insert the eyeglass lens blank in the rotatable holder to grind the optical surfaces and/or the circumferential edge of eyeglass lenses can be joined therein with the rotatable holders for grinding the optical surfaces and/or the circumferential edge in a single handling device or separate handling devices which are joined with a common control unit.

The optical values and the axial orientation are determined by the ophthalmologist or optician for the person requiring the corrective lenses. The decentration values are derived from the interpupillary distance for this person in relationship to the geometric center of the selected eyeglass lens.

Blocking the eyeglass lens blank before inserting it in the holder in the eyeglass lens grinding machine can be eliminated if the holder is designed so that it clamps the eyeglass lens blank, exactly positioned by the handling device, in such a way as to prevent relative rotary movement.

To now be able to align automatically the appropriate eyeglass lens blank, it is possible to locate within the reach of the handling device a vertex refractometer which exhibits a sensor and a data link to the control unit, used to position the eyeglass lens blank held by the handling unit along the optical center and to register the data at the optical center to be used for subsequent, exactly positioned insertion of the eyeglass lens blank in the holder.

Another option for controlling the handling device can be provided with a machine-readable marking of the optical values on the eyeglass lens blank. The eyeglass lens blank grasped by the handling device can then be moved into the range of a sensor where the optical values are read. By means of a data link to the control unit it is possible to control exactly positioned insertion of the eyeglass lens blank in the holder in dependency on the optical values including the dioptric index registered by the sensor and the decentration values previously entered and/or the axial orientation.

A larger number of differing eyeglass lens blanks can be located in a storage container which is accessible to the handling unit, wherein a machine-readable marking can be located on the storage container for each of the eyeglass lens blanks, serving as an address which is read by a sensor at the handling device and on the basis of which, via a data link to the control unit, the removal of an eyeglass lens from the storage container is controlled in conformity with the optical values previously entered.

The storage container may be designed so that the eyeglass lens blanks are already positioned in the correct attitude as regards their optical values and can be removed in this attitude, so that no additional control command for the optical values, namely and in particular for the location of close vision sections in the eyeglass lens blank, is required and the handling device need undertake only positioning as per the decentration values and axial orientation.

It is, however, just as possible to position the eyeglass lens blanks in the storage container in any desired orientation and to undertake positioning in the way previously described using machine-readable marks applied to the eyeglass lens blank or by means of a vertex refractometer.

To achieve an exactly positioned connection, resistant to relative rotation, at the rotatable holder in an eyeglass lens grinding machine, devices to attach a sucker or holder block on the eyeglass lens blank are normally utilized, particularly in conventional eyeglass lens edging machines. These devices, when utilized in the usual fashion, are fitted with optical and/or opto-electronic devices so as to be able to align the eyeglass lens blanks in conformity with the optical values, the decentration values and/or the axial orientation.

If the handling device proposed by way of invention is utilized in conjunction with a conventional eyeglass lens grinding machine, the handling unit can be used to exactly position an eyeglass lens blank in dependency on the optical values, the decentration values and/or the axial orientation in a very simple device by using a sucker or holder block and then by attaching the sucker or holder block on the eyeglass lens blank. Subsequently the eyeglass lens blank together with the sucker or holder block attached to it can be placed in the holder of a conventional eyeglass lens grinding machine and there fixed exactly in position.

The control unit can advantageously comprise an electronic computer with memory capacity and a data link both to the handling unit and to an eyeglass lens grinding machine, so that the control unit can be used both to control the handling unit and also to control the eyeglass edge grinding machine. For this purpose the control unit may exhibit an input device for the decentration values and/or the axial orientation and the optical values including the dioptric index of the eyeglass lens blank to be ground and for the circumferential contour of the eyeglass lens to control exactly positioned insertion of the eyeglass lens blank in the holder and the grinding of the eyeglass lens. The circumferential contour of the eyeglass lens can be entered into the control unit in various ways, themselves known, e.g. by tracing the selected eyeglass frame and forwarding the values to the computer and/or data memory, by transferring the data stored on diskette for a particular eyeglass frame or by storing a large number of eyeglass frame data sets in the data memory and calling up the data for a certain eyeglass frame by entering a code number or by reading this code number from a bar code which may be applied to the eyeglass frame affected or to its packaging.

Using a control unit of this type comprising an electronic computer with data memory and with a handling device which it controls makes it possible to load eyeglass lens blanks in a larger number of eyeglass lens grinding machines located within the reach of the handling unit and to grind them in accordance with the data available in the control unit. In this fashion it is possible to set up machining centers for grinding the eyeglass lenses which comprise the machines for grinding the optical surfaces and eyeglass edging machines and which are particularly of advantage where eyeglasses are fit and sold in department stores or branch stores.

BRIEF DESCRIPTION OF THE DRAWING

With these and other objects in view, which will become apparent in the following detailed description, the present invention, which is shown by example only, will be clearly understood in connection with the accompanying drawing, in which.

DETAILED DESCRIPTION OF THE PREFERRED EMBODIMENTS

Figure 1:
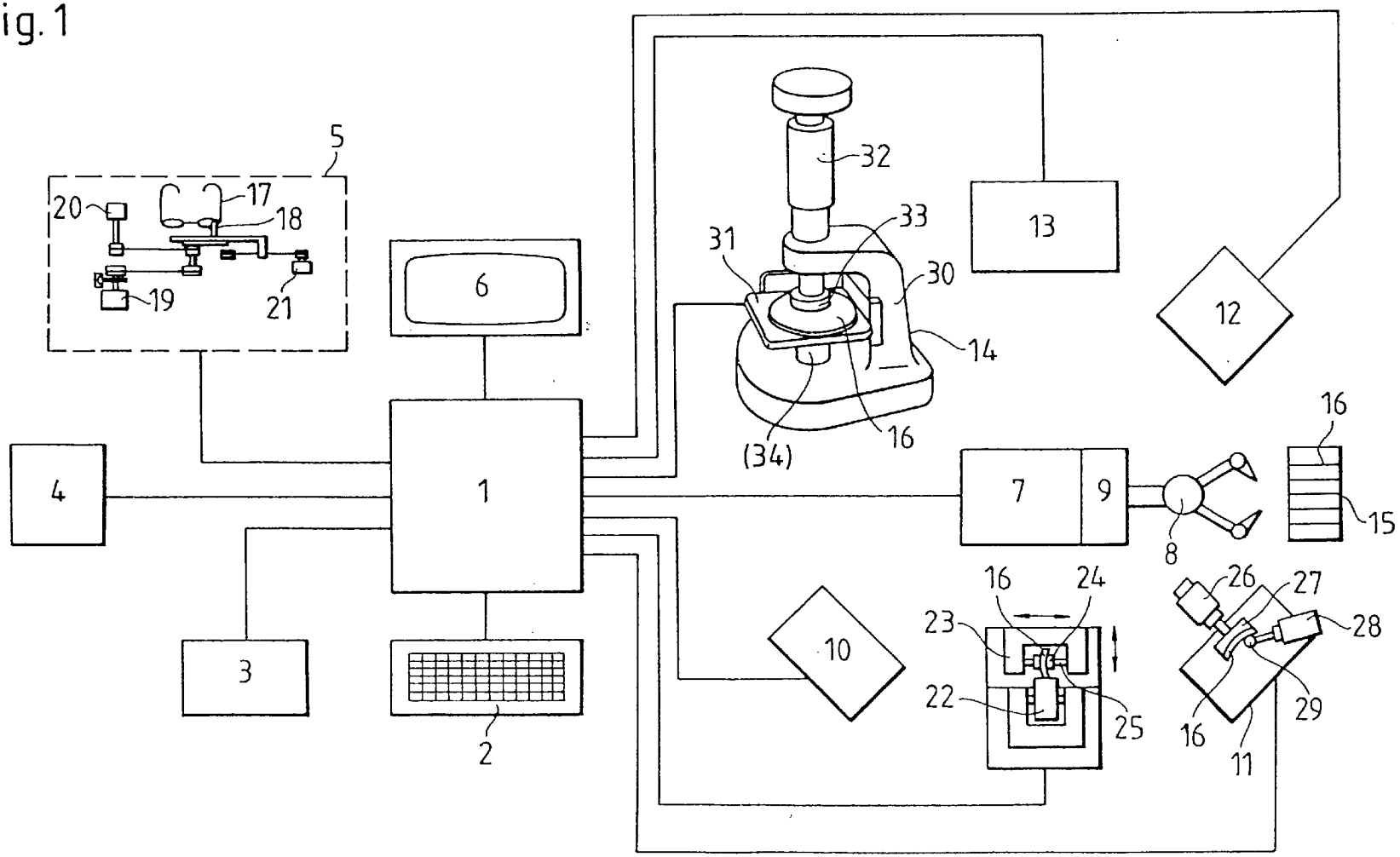
FIG. 1 shows a schematic representation of a machining center comprising a machine for grinding the optical surfaces of an eyeglass lens blank and a machine to grind the edge of an eyeglass lens blank.

The machining center shown in FIG. 1 includes a control unit 1 in the form of an electronic computer with data memory capacity, e.g. a personal computer. The control unit has an input device 2 in the form of an alphanumeric keyboard by means of which the decentration values, the orientations of the axes and/or the optical values for the eyeglass lens to be manufactured are entered. Additional input devices for the control unit 1 can include a bar code reader 3, a diskette drive 4 and/or an eyeglass lens tracing device 5. The bar code reader 3 can read both the code number for a given eyeglass frame and the optical values from an appropriately marked eyeglass lens blank. In this case the whole of the digitalized data set for an eyeglass frame and the circumferential contour of the eyeglass lens resulting therefrom are already present in the memory of the control unit 1 and will be called up by entering the code number. If the data for an eyeglass frame are not already present in the memory of the control unit 1, then these data can be transferred to the control unit 1 from a diskette which is read by the diskette drive 4.

Finally, the data values for the circumferential contour of the eyeglass lens to be manufactured can be determined on the basis of a physically present eyeglass frame by tracing this eyeglass frame in an eyeglass frame tracing device 5.

An eyeglass lens tracing device 5 of this type is described in U.S. Pat. No. 4,945,684. An eyeglass frame 17 is mounted in this device and a stylus 18 is positioned in the V-shaped groove of the eyeglass frame opening. This stylus 18 is moved along the V-shaped groove at the eyeglass frame opening by means of a rotation drive 19 for the stylus 18, wherein an angle transducer 20 transfers the momentary angular position of the stylus 18 while a linear position transducer 21 transfers the radius from the rotation axis to the V-shaped groove as the data set for the circumferential contour of the eyeglass frame opening to the control unit 1, where this data set is stored.

A view data screen 6 serves to display the values entered so that they can be verified; it can also be used to illustrate the predetermined circumferential contour of the eyeglass lens and to check the decentration values with reference to the size of the eyeglass lens blank.

Linked via a data cable to the control unit 1 is a handling unit 7 exhibiting a manipulator arm 8 used to grasp an eyeglass lens blank. A sensor 9, shown schematically, is also present at the handling unit 7. An eyeglass lens blank 16 held by the manipulator arm 8 is placed by means of the handling unit 7 into an opened holder 24, 25 in an eyeglass lens edging machine 10. A CNC-controlled eyeglass lens edging machine of this type is built and distributed by the applicant, e.g. under model designation CNC 90. Another CNC-controlled eyeglass lens edging machine is illustrated and described in U.S. Pat. No. 4,945,684. Details of these eyeglass lens edging machines need therefore not be given. It suffices to mention that a powered grinding disk 22 is located in a carrier housing and that the eyeglass lens holder shaft 24 with holder blocks 25 for the eyeglass lens blank 16 are located on a CNC-controlled skid 23 which is slidable in the direction indicated by the arrows.

In the embodiment shown two eyeglass lens edging machines 10 and a machine to grind the optical surfaces of an eyeglass lens blank are located within the reach of the handling unit 7.

A machine of this type to grind the optical surfaces of an eyeglass lens blank is described in U.S. Pat. No. 5,210,695 (published after the priority date of the present application), comprising a rotary drive 26 with the block 27 to which the eyeglass lens blank 16 is affixed. Further, a rotary drive 28 for a grinding or milling head 29 is present. The rotary drive 26 with a block 27 and the eyeglass lens blank 16 along with the rotary drive 28 with the grinding or milling head 29 can be moved relative one to another translatorally and rotationally under CNC control and generate in this way the optical surface facing the grinding or milling head 29. The second optical surface of the eyeglass lens blank will as a rule already have been ground so that this pre-ground optical surface of the eyeglass lens blank 16 can be affixed to the block 27 while the other optical surface of the eyeglass lens blank 16 which is to be ground remains accessible.

Also located within the reach of the handling unit 7 are a sensor 12, a vertex refractometer 13, a blocking unit 14 and a storage container 15 in the form of a tray for eyeglass lens blanks 16.

Present in the storage container 15 is a large number of differing eyeglass lens blanks 16 which are provided with an address on the storage container 15 in the form of a machine-readable marking. The decentration values, the optical values and where appropriate the axial orientations are entered at the keyboard 2, in response to which via the operation of the control unit 1 the handling unit 7 uses the address marked on the storage container 15 to seek and grasp the appropriate eyeglass lens blank 16.

If the eyeglass lens blanks 16 in the storage container 15 are aligned with a specific orientation axis according to their optical values, e.g. the axial orientations of a cylindrical or prismatic grind and/or the location of close vision sections in relationship to the optical axis, the handling unit 7 will move directly to the blocking unit 14 the eyeglass lens blank 16 selected and removed, align the eyeglass lens blank 16 according to the decentration values and the axial orientation, and a sucker or holding block 33 will be attached to the eyeglass lens blank 16 under the control of the control unit 1. A device 14 of this type for attaching a sucker or holding block 33 may comprise a U-shaped frame 30 which exhibits a bearing surface 31 for an eyeglass lens blank 16. The handling unit 7 lays the eyeglass lens blank 16, positioned exactly in regard to the decentration values and/or the axial orientations of a cylindrical or prismatic grind or the position of a close vision area, on the bearing surface 31 whereupon the block or sucker 33 is affixed to the eyeglass lens blank 16 by means of an axial motion drive 32 controlled by the control unit 1.

Turning away from the blocking unit 14, the handling unit 7 turns toward one of the eyeglass lens edging machines 10 and inserts the eyeglass lens blank 16 in the holder device 24, 25. The holder device, exactly positioned, locks in place in the sucker or holding block 33 affixed to the eyeglass lens blank 16, the manipulator arm 8 releases the eyeglass lens blank, and the handling unit 7 withdraws from the area at the eyeglass lens edging machine 10 which, under the operation of the control unit 1, then carries out final grinding of the eyeglass lens blank 16 in accordance with the predetermined circumferential contour of the eyeglass.

In the meantime the handling unit 7 can return to the storage container 15, pick up a further eyeglass lens blank 16 and manipulate it in the manner previously described to load the second eyeglass lens edging machine 10.

If the eyeglass lens blanks 16 in the storage container 15 are not arranged in a specific angular orientation, a sensor 12 can be used to determine the axial orientation of the cylindrical or prismatic grind and/or of a close vision section present in the eyeglass lens blank 16 in reference to the optical axis of the distant vision area if the appropriate information is provided on the eyeglass lens blank in the form of a machine-readable marking, e.g. a bar code. The sensor 12 acquires these data, forwards them to the control unit 1 and this control unit 1 causes the handling unit 7 to position the eyeglass lens blank accordingly in the blocking unit 14. Then the eyeglass lens blank 16 is placed in one of the eyeglass lens edging machines 10 in the prescribed fashion.

If there are no machine-readable markings on the eyeglass lens blank 16, then the handling unit 7 places the eyeglass lens blank in a vertex refractometer 13 which automatically measures the optical center of the distant vision area and the axis of a cylindrical or prismatic grind and/or the location of a close vision section in the eyeglass lens blank and forwards to the control unit 1 the data thus determined. The control unit 1 converts these data into commands for the handling unit 7 which then exactly orients the eyeglass lens blank in accordance with these data, places it in the blocking unit 14, and after application of a sucker or holding block moves it to one of the eyeglass lens edging machines 10.

The vertex refractometer 13 can be of a design similar to the blocking unit 14 but will exhibit in addition below the bearing surface 31 made of glass an optical-electronic device 34 which serves to determine the optical center of the distant vision area, the axis of a cylindrical or prismatic grind and/or the location of a close vision section in the eyeglass lens blank and to forward this information to the control unit 1 in the form of a data set. A vertex refractometer of this type is described in EP Patent Specification 177 935. This vertex refractometer 13 can be fitted with the axial motion drive 32 described in reference to the blocking unit 14 and can be set up to apply a holding block or sucker 33 so that in this case the blocking unit 14 will not be required.

As previously mentioned, this eyeglass lens edging machine 10 is preferably a Model CNC 90 CNC controlled eyeglass lens edging machine manufactured by the applicant. The operations of these eyeglass lens edging machines are controlled by the control unit 1 and automatically execute grinding of the eyeglass lens blank down to the predetermined circumferential contour for the eyeglass lens. The handling unit 7 can, however, also be used with simple eyeglass lens edging machines which are not CNC controlled and which are manufactured and distributed by the applicant under model designation C 90. In this case the grinding of the predetermined circumferential contour of the eyeglass lens is executed by means of a template exhibiting this same circumferential contour and which is mounted on the rotatable holder for the eyeglass lens blank. The control unit 1 in this case only transmits a control command to close the holder for the eyeglass lens blank once the handling unit 7 has positioned the eyeglass lens blank in the correct attitude between the open halves of the holder and issues the starting command for the grinding operation. The grinding phase itself runs completely automatically but is, however, controlled by the template as regards the eyeglass lens contour.

After completion of the grinding operation the ground eyeglass lens can be removed from the eyeglass lens edging machine 10 either manually or with the handling unit 7 and mounted in the appropriate eyeglass frame.

In the illustrated embodiment a sucker or holder is applied to the eyeglass lens blank placed in the holder device. It is, however, possible to do without this device if the holder is designed so that it clamps without need of further auxiliary means the eyeglass lens blank which had been positioned exactly by way of the handling unit 7.

Instead of the separate eyeglass lens edging machine 10 and the grinding machine 11 for grinding the optical surfaces of an eyeglass lens as described, machines can also be employed which grind both the optical surfaces and the edge.

Figure 2:
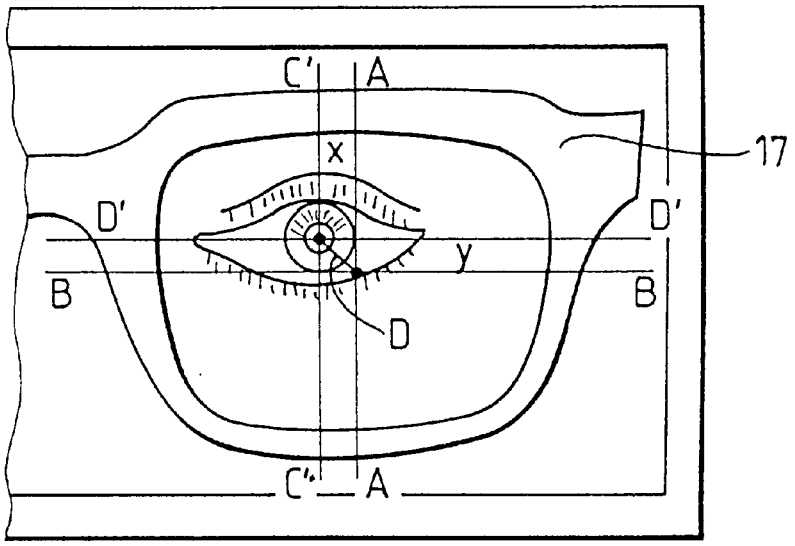
FIG. 2 illustrates schematically the known method of locating the pupils of an eyeglass wearer with respect to the geometric center of a selected eyeglass frame.
Figure 3:
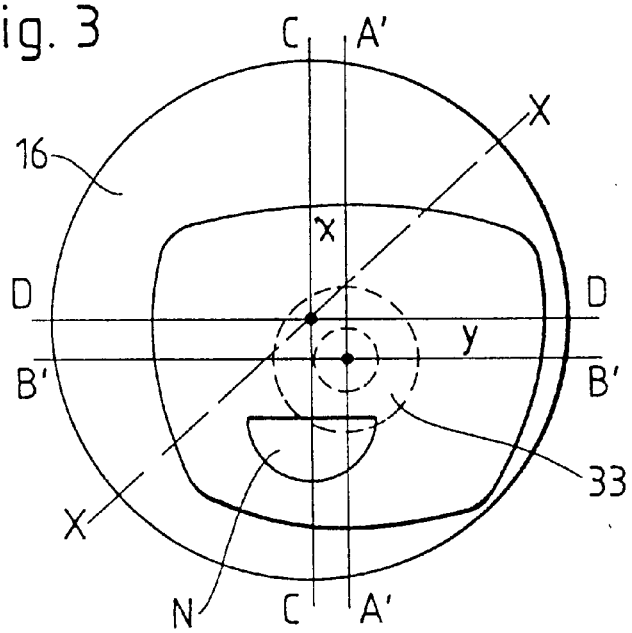
FIG. 3 illustrates an eyeglass lens blank and an eyeglass lens shaped to match the eyeglass lens opening in a selected eyeglass frame, including a depiction of the optical center of the eyeglass lens with reference to the geometric center of the lens opening in the eyeglass frame.

Reference is made to FIGS. 2 and 3 to clarify what is meant by decentration value, axial orientation of a cylindrical or prismatic grind and position of the close vision section.

The eyeglass frame 17 is shown in FIG. 2 and the eye of the wearer of this selected eyeglass frame 17 can be recognized. A—A indicates a vertical center line and B—B a horizontal center line, the intersection of which forms the geometric center of the eyeglass lens opening in the eyeglass frame 17. The pupils of the person wearing the eyeglass lens frame exhibit a distance D from the intersection of axes A—A and B—B. This is the decentration value of the pupil in reference to the geometric center of the eyeglass lens opening in the eyeglass frame 17. This distance D differs for every eyeglass frame and for every individual wearer of this eyeglass frame and is measured by the optician after a certain eyeglass frame 17 has been selected. Shown in FIG.

2 is a vertical center line C'—C' passing through the pupil and a horizontal center line D'—D' which is offset in the Y and X directions in relationship to center lines A—A and B—B and which result in the coordinates (decentration values) of distance D.

Shown in FIG. 3 is an eyeglass lens blank 16 through the optical center of which a vertical line C—C and a horizontal line D—D are sketched. The intersection of line C—C with D—D is the optical center of the eyeglass lens blank 16 and must align with lines C'—C' and D'—D', respectively, in FIG. 2. To achieve this, the circumferential edge of the eyeglass lens to be mounted in the eyeglass frame 17 is ground in such a way that the geometric center is offset from the optical center by distance D, illustrated in FIG. 2. To this end the handling unit 7 either from the very outset offsets the eyeglass lens blank 16 accordingly in the eyeglass lens holder 24, 25 or a holding block or sucker 33 is affixed to the eyeglass lens blank 16 in the blocking unit 14 in such a way that the axis of the shaft intersects with the intersection of lines A'—A' and B'—B' at the eyeglass lens blank 16 in FIG. 3.

If the eyeglass lens blank 16 exhibits a cylindrical or prismatic grind along an axis X—X, then axis X—X must assume a certain angular orientation within the eyeglass frame 17, based on the individual data for the person wearing the eyeglass frame 17. This angular orientation of the X—X axis must also be taken into consideration when mounting the eyeglass lens blank 16 in the eyeglass lens edging machine 10 or when attaching a holding block or sucker 33 in the blocking unit 14. The same applies for a close vision section N, so that when an eyeglass lens is edged not only the decentration values, but also the axial orientation of a cylindrical or prismatic grind and the location of a close vision section are to be taken into account.

These values can, in fact, also be achieved by recalculating the data set describing the circumferential contour of the eyeglass lens to be mounted in a certain eyeglass frame 17, but this leads to considerable computing effort requiring a complicated computing program and longer computing time.

Figure 4:
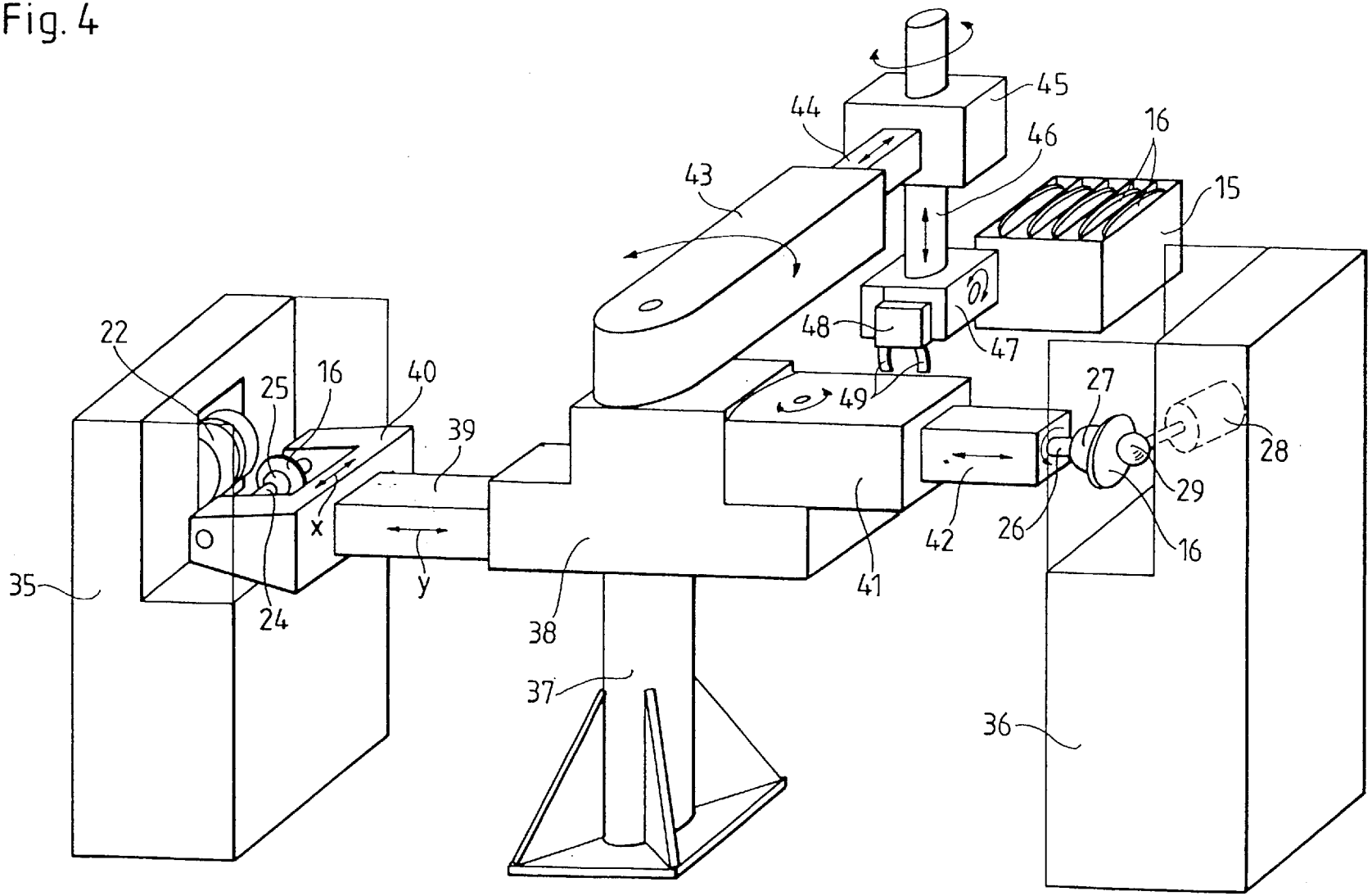
FIG. 4 shows a perspective view of a handling unit with holders for eyeglass lens blanks and simple grinding machines to grind the optical surfaces and the circumferential contour of an eyeglass lens blank.

Shown in FIG. 4 is a further, advantageous embodiment of the handling unit in which the machines used to grind the edge and the optical surfaces of an eyeglass lens blank are considerably simplified.

The device used to edge the eyeglass lens blank comprises a carrier housing 35 in which a grinding disk 22 or other rotating machining tool is mounted on a spindle with a rotary drive.

Located diametrically opposite is a further carrier housing 36 which serves as the carrier for the rotary drive 28 of a grinding or milling head 29 used to machine the optical surfaces of an eyeglass lens blank 16.

The handling unit 7 in the embodiment shown in FIG. 4 comprises a stable stand 37 to which a head 38 is attached. This head 38 serves, on the one hand, as an exact guide for a beam 39 which is telescopically slidable in the Y direction, upon which is located a carrier 40 for the eyeglass lens holder shaft 24 with holder blocks or suckers 25. Located in the carrier 40 are a rotary drive for the eyeglass lens holder shaft 24 and in addition an axial shifting drive for the eyeglass lens holder shafts 24 along the X direction.

At the opposite end of the head 38 is a beam 41 which is rotatable about a vertical axis at the head 38 and which serves as the precise guide for a telescopically slidable beam 42 which is shiftable along the Y direction. The beam 42 serves as the carrier for the rotary drive 26 of the block or sucker 27 to which the eyeglass lens blank 16 is affixed.

Attached above the head 38 is an arm 43 which is rotatable about a vertical axis passing through the stand 37, which serves as a precise guide for a telescopically slidable beam 44 which is shiftable in the Y direction. The beam 44 carries a head element 45 in which a beam 46 is telescopically slidably mounted so as to be vertically shiftable and rotatable. This beam in turn is provided with a further head element 47 on which a gripper jaw wrist 48 is mounted which is slidable mounted along a horizontal axis. Mounted at the gripper jaw wrist 48 are gripper jaws 49 with opposed motion, which serve to grasp an eyeglass lens blank.

All movements of the handling unit 7 are effected under CNC control via a link with the control unit 1.

Figure 5:
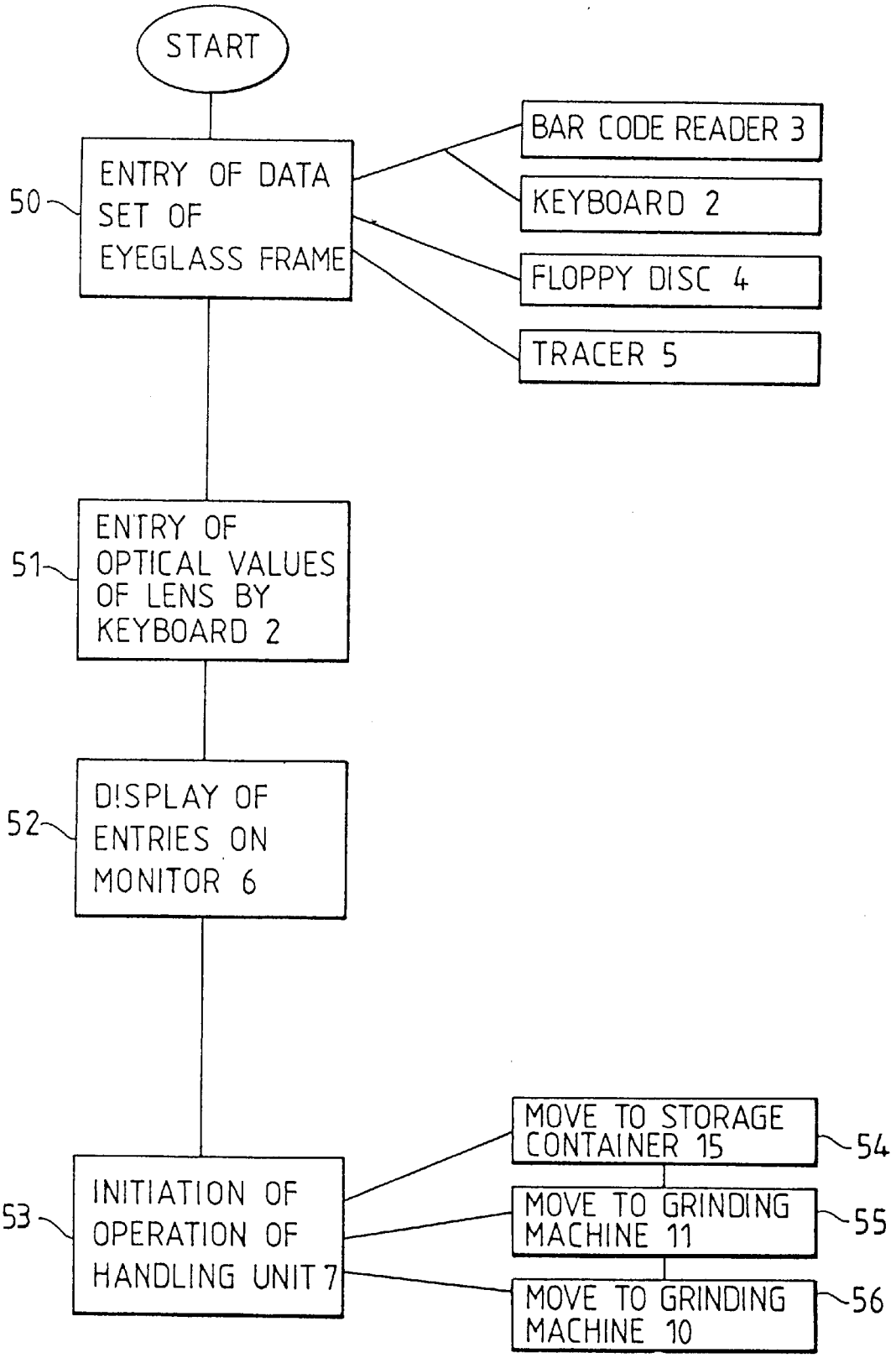
FIG. 5 depicts in a block diagram the sequence for machining an eyeglass lens to form the optical surfaces and to shape the contour at the circumference.

The sequence for machining the optical surfaces and the eyeglass lens edge is shown in FIG. 5. The entry of the start command at the keyboard 2 is followed by the entry 50 of the data set describing the eyeglass lens opening in a selected eyeglass frame. This can be done in one of several different ways, e.g. the data set for a large number of eyeglass frames can already be in storage in the memory of the control unit 1 so that it will be sufficient to select a particular eyeglass frame. This can be done by entering the code for a certain eyeglass frame at the keyboard 2 or by reading an appropriate bar code on the eyeglass frame or its packaging using a bar code reader 3. If the data set corresponding to a particular eyeglass frame has not been entered in the computer, a diskette bearing this data set can be inserted in a diskette drive linked with the control unit 1 so that this data set is copied to the memory of the control unit 1.

Finally, it is possible to trace an eyeglass lens opening in a selected eyeglass frame 17 at the eyeglass lens tracing device 5 and to enter in the control unit 1 the data set thus determined.

Once the selected eyeglass frame with data conditioned for computer processing is present, there follows the entry 51 of the optical values for the surface of the eyeglass lens prescribed by an optician or ophthalmologist for the person wearing the eyeglass frame 17 and possibly for a close vision section, if present, along with the axial orientation of a cylindrical and/or prismatic grind and the decentration values of the eyeglass wearer with reference to the selected eyeglass frame 17.

Once these data set entries 50, 51 have been completed a display 52 is presented in the view data screen 6 to verify the data entered, possibly together with the display of the required diameter of the eyeglass lens blank.

Control 53 of the handling unit 7 is initiated with a start key at the keyboard 2. Operating on the basis of the entries, the handling unit 7 is controlled so that-the gripper jaws 49 move toward the storage container 15 and remove an eyeglass lens blank 16. This eyeglass lens blank 16 exhibits one optical surface which has already been machined and an unfinished surface. The eyeglass lens blank 16 held by the gripper jaws 49 is then positioned on the block 27 with its geometric axis coaxial to the rotary drive 26, in such a way that the unmachined surface is facing toward the grinding or milling head 29. The optical surface is now machined by the eyeglass lens blank 16 being set in slow rotation around its geometric axis by means of the rotary drive 26 while at the same time the beam 42 executes a CNC-controlled movement in the Y direction and the beam 41 executes a CNC-controlled turning motion around its vertical axis. These motions are programmed so that the interaction of the rotating grinding or milling head 29, the rotation of the eyeglass lens blank 16 and the translatory movements of the beam 41 with the beam 42 gives an optical surface corresponding to the prescribed values, possibly including a cylindrical and/or prismatic grind as well as a close vision section.

Once the grinding of the optical surface has been completed including a polishing phase which is not illustrated in detail, the eyeglass lens blank 16 is removed by the block or sucker 27 by means of the gripper jaws 49 and positioned by them between the separated holder blocks 25 at the eyeglass lens holder shaft 24. Here the eyeglass lens blank 16 is positioned with its geometric axis, the axial orientation of a cylindrical and/or prismatic grind, as well as the location of a close vision section exactly in accordance with the data entered regarding the eyeglass wearer including the decentration value referenced to the selected eyeglass frame 17, so that when the holder blocks 25 at the eyeglass lens holder shaft 24 are closed the eyeglass lens blank 16 is held in accordance with the mentioned values and in such a way so as to prevent relative rotation. The rotation drive for the grinding disk 22 is now activated and the carrier 40 at the beam 39 is moved in the Y direction under CNC control so that the eyeglass lens blank 16 is edged during simultaneous, slow rotation of the eyeglass lens holder shaft 24 so as to impart the shape required for the selected eyeglass frame.

To achieve uniform wear of the grinding disk 22, the eyeglass lens holder shaft 24 with the eyeglass lens blank 16 or the carrier 40 executes a reciprocal motion along the X axis. After edging of the eyeglass lens blank 16 is completed a bevel is applied by moving the circumferential edge of the contoured eyeglass lens into the area of a V-shaped groove in the grinding disk 22. The bevel is also ground under CNC control in the Y and X directions, to take into account the circumferential contour and the development of the three-dimensional curve of the contoured eyeglass lens.

It is apparent from the foregoing description that the grinding of the eyeglass lens can be completed quickly, accurately and without requiring any particular handicraft skills.

In the operating sequence as per FIG. 5 it is assumed that the values for the optical center, the axial orientation, the location of the close vision section resulting from the grinding of the optical surfaces can be stored in such a way that the gripper jaws 49 can remove the eyeglass lens blank 16, correctly oriented, from the block 27 and accordingly also place it in the correct orientation between the holder blocks 25 of the eyeglass lens holder shaft 24.

Figure 6:
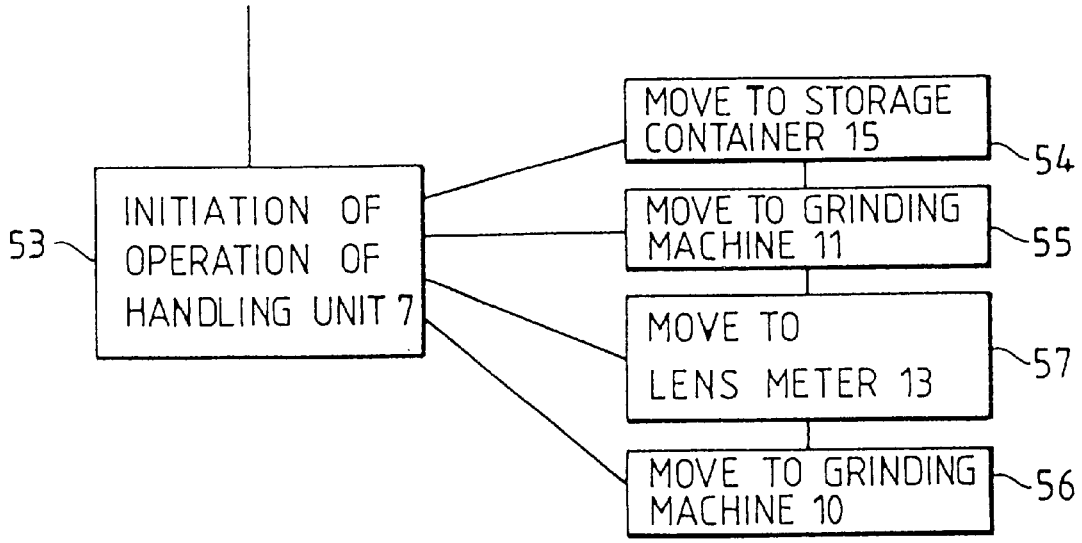
FIG. 6 shows a detail from the sequence diagram as per FIG. 5 when utilizing a vertex refractometer.
Figure 7:
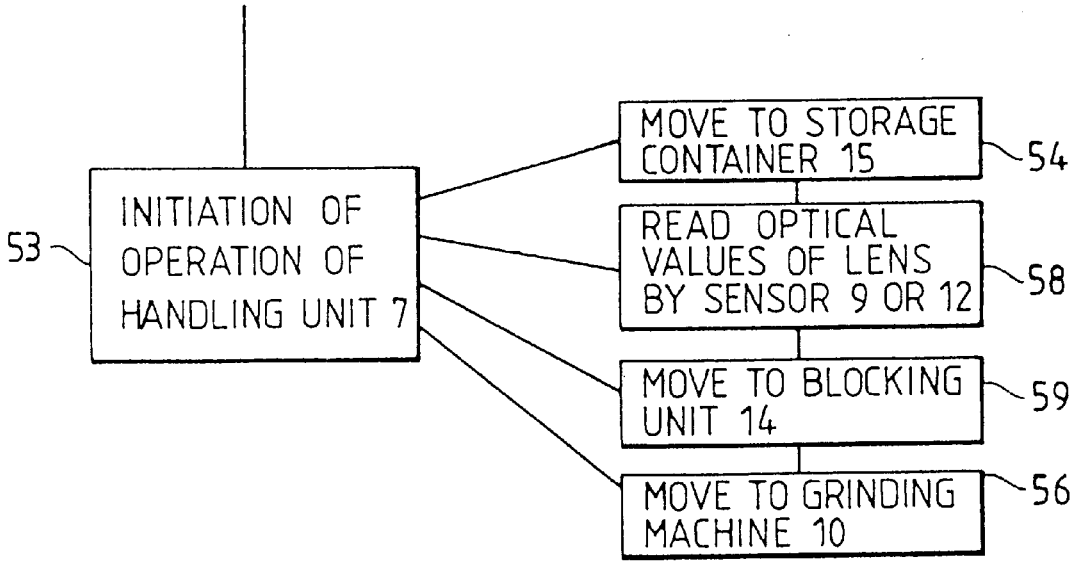
FIG. 7 shows a detail from the sequence diagram when using a blocking device.

The operating sequence as per FIG. 6 shows a variation in which the control 53 of the handling unit 7 is effected in such a way that the removal 54 from the storage container 15 is carried out and the eyeglass lens blank 16 is mounted in the grinding machines 11 used to grind the optical surface.

After removing the eyeglass lens blank 16 from the grinding machine 11 which finishes it in regard to its optical surfaces, there follows the placement 57 of the eyeglass lens blank 16 in the vertex refractometer 13 where optical electronic means are used to determine the orientation of the optical axis for the distant vision section, the associated location of the close vision section and the axial orientation of a cylindrical and/or prismatic grind, these values being forwarded to the control unit 1. Operating on the basis of this data set, the control unit 1 controls the handling unit 7 in the fashion previously described in such a way that the grinding of the circumferential edge of the eyeglass lens blank in the eyeglass lens edging machine 10 is effected in accordance with these values.

If the eyeglass lens edging machine 10 is one designed in such a way that an eyeglass lens blank 16 can be accepted in precise position between the eyeglass lens holder shafts 24 only when the eyeglass lens blank 16 is fitted with a holding block 33 and if the eyeglass lens blank 16 has already been completely ground as regards its optical surfaces, the removal 54 from the storage container 15 can be effected in the manner described, whereafter the reading 58 of the optical values from a machine-readable marking on the storage container 15 or on the eyeglass lens blank 16 itself by means of the sensor 9 or the sensor 12 is effected. The placement 59 in the blocking unit 14 then follows, where the eyeglass lens blank 16 is positioned in accordance with the decentration values, the axial orientation of a cylindrical and/or prismatic grind and/or the location of a close vision section on the bearing surface 31 and whereby the holding block 33 is applied by actuating the axial motion drive 32. There follows the insertion 56 in the eyeglass lens edging machine 10, which may be carried out in accordance with FIG. 1 or in accordance with FIG. 4.

Various changes as would be obvious to one having the ordinary skill in this art, may be made in the above construction without departing from the scope of the present invention. The above description is illustrative of a preferred embodiment. Particular features of the invention are emphasized in the claims appended hereto.

I claim:

1. System for machining the optical surfaces and/or the circumferential edge of eyeglass lenses with, comprising in combination, at least one machining tool;

at least one device to control the machining of the machine tool in accordance with predetermined optical values and/or a predetermined circumferential shape for the eyeglass lens;

at least one input device for supplying data sets to the control unit of the optical values of the eyeglass lens and/or for the decentration values of the predetermined circumferential shape with reference to the optical axis of the eyeglass lens;

at least one rotatable holder for an eyeglass lens blank; and a CNC-controlled handling unit, connected with the control unit, picks up an eyeglass lens blank and inserts it in exact position in the holder.

2. System according to claim 1, including an input device (2) to enter the data set into the control unit (1) for the axial orientation of the predetermined circumferential shape in eyeglass lenses with cylindrical or prismatic grind.

3. System for machining the optical surfaces and/or the circumferential edge of eyeglass lenses, comprising in combination, at least one machining tool, at least one computer device to control the machining tool in accordance with predetermined optical values and/or a predetermined circumferential shape for the eyeglass lens, at least one input device for the optical values of the eyeglass lens and/or for the decentration values of the predetermined circumferential shape and/or the location of the close vision section with reference to the optical axis of an eyeglass lens to be machined, at least one control unit linked with the input device, at least one CNC-controlled rotatable holder for an eyeglass lens blank, linked with the computer device to control machining, and at least one CNC-controlled handling unit, connected with the control unit, to pick up and position an eyeglass lens blank in accordance with the values entered at the input device and to insert the eyeglass lens blank in the exact position in the holder.

4. System according to claim 3, wherein said holder is operatively mounted on said CNC-controlled handling unit.

5. System according to claim 4, including a handling unit fitted with a holder for machining the optical surface of the eyeglass lens.

6. System according to claim 3, including a handling unit fitted with a holder for machining the circumferential edge of the eyeglass lens.

7. System according to one of the claim 6, the holder(s) at the handling unit being located so as to pick up and position the eyeglass lens blank and to insert it in exact position in the holder(s).

8. System according to claim 7, including a vertex refractometer (13) mounted within the reach of the handling unit (7), which is equipped with a sensor and a data link to the control unit (1) for aligning at its optical center the eyeglass lens blank held by the handling unit (7) and registering the optical center for subsequent placement of the eyeglass lens blank in the holder in exact position.

9. System according to claim 7, wherein a machine-readable marking of the optical values is disposed on each. eyeglass lens blank and a sensor (9, 12) is connected to the control unit (1) to pick up the optical values via a data link to control the exactly positioned insertion of the eyeglass lens blank in the holder in dependency on the optical values and the decentration values and/or the axial orientation entered.

10. System according to claim 7, wherein a machine-readable marking serving as the address for each of a number of differing eyeglass lens blanks held in a storage container (15) is affixed to the storage container (15) which is located within the reach of the handling unit (7), a sensor (9) at the handling unit, a data link to the control unit (1) to control the removal of an eyeglass lens blank from the storage container in accordance with the entered optical values.

11. System according to claim 9, wherein said a control unit (1) comprises an electronic computer with data memory, with a data link both to the handling unit (7) and to an eyeglass lens edging machine (10), an input device (2, 3, 4, 5) for the optical values and/or the decentration values and/or the axial orientation of the eyeglass lens blank to be ground as well as for the circumferential shape of the eyeglass lens, to control the exactly positioned insertion of the eyeglass lens blank in the holder and the grinding of the circumferential shape of the eyeglass lens.

12. System according to claim 11, wherein said handling unit (7) with a control unit (1) and an input device (2) is provided with several eyeglass lens edging machines (10) located within the reach of the handling unit.

13. System according to claim 12, wherein a device (14) is mounted within the reach of the handling unit (7) to apply a sucker or holder block to the eyeglass lens blank which has been placed by the handling unit in an exact predetermined position, in dependency on the optical values, the decentration values and/or the axial orientation of the eyeglass lens placed in the device.

* * * * *